US005522196A

United States Patent [19]

Conroy et al.

[11] Patent Number: 5,522,196

[45] Date of Patent: Jun. 4, 1996

[54] THIN WALL PROFILE HAVING OUTER WEATHER BAND ULTRA VIOLET LIGHT RESISTANT LAYER

[75] Inventors: Paul M. Conroy, Pittsfield, Mass.; Donald W. DeMello, Austin, Tex.; Wolfgang Gasselseder, Oberneukirchen, Austria; John F. Lubera, Catskill, N.Y.

[73] Assignee: General Electric Company, Pittsfield, Mass.

[21] Appl. No.: 232,800

[22] Filed: Apr. 25, 1994

[51] Int. Cl.[6] ..... F04C 3/36

[52] U.S. Cl. ..... 52/738.1; 52/204.6; 52/730.4; 52/730.6; 52/731.2; 52/734.2; 52/736.3; 49/DIG. 1; 49/DIG. 2

[58] Field of Search ..... 52/204.1, 204.55, 52/727, 730.3, 731.1, 732.1, 738.1, 204.6, 730.4, 730.6, 731.2, 734.2, 736.3; 49/DIG. 1, DIG. 2

[56] References Cited

U.S. PATENT DOCUMENTS

| | | | |
|---|---|---|---|
| 3,859,754 | 1/1975 | Budich et al. . | |
| 3,964,231 | 6/1976 | Budich et al. . | |
| 4,057,936 | 11/1977 | Wyatt, Jr. et al. | 49/DIG. 1 X |
| 4,130,976 | 12/1978 | Kesseler . | |
| 4,370,830 | 2/1983 | Schaefer . | |
| 4,492,063 | 1/1985 | Schock et al. . | |
| 4,516,356 | 5/1985 | Delman . | |
| 4,569,154 | 2/1986 | Bayer . | |
| 4,676,026 | 6/1987 | Schreiner . | |
| 4,831,781 | 5/1989 | Morton . | |
| 4,924,628 | 5/1990 | Ruby et al. | 49/DIG. 2 X |
| 4,977,722 | 12/1990 | Taylor | 52/730.3 |

FOREIGN PATENT DOCUMENTS

| | | |
|---|---|---|
| 26795 | 4/1981 | European Pat. Off. . |
| 28775 | 5/1981 | European Pat. Off. . |
| 50462 | 4/1982 | European Pat. Off. . |
| 133838 | 3/1985 | European Pat. Off. . |
| 2241683 | 3/1975 | France . |
| 2354861A1 | 5/1975 | Germany . |
| 4321969 | 2/1994 | Germany . |
| WO9208867 | 5/1992 | WIPO . |

*Primary Examiner*—Carl D. Friedman
*Assistant Examiner*—Christopher Todd Kent

[57] ABSTRACT

This invention is directed to an extruded thermoplastic, thin-walled, high definition profile structure having a central hollow cross sectional member with at least two flange members extending perpendicularly therefrom and longitudinally therewith wherein at least one flange member extends from one side of the cross sectional member and at least one flange member extends from the other side thereof. Preferably, there are three flange members extending from one side forming channel-like recesses and one flange extending from the other side of the cross sectional member.

Also included herein are particular thermoplastic resins that can be employed in making the profile structure of this invention. For example, the profile can be a composite comprising a substrate of acrylonitrile-butadiene-styrene and a thin outer layer of polyvinyl chloride or a blend of polyvinyl chloride and acrylic-styrene-acrylonitrile.

The profile of this invention is suitable as frames for openings in buildings, particularly frames for windows, doors and the like.

5 Claims, 4 Drawing Sheets

THIN WALL PROFILE HAVING OUTER WEATHER BAND ULTRA VIOLET LIGHT RESISTANT LAYER

BACKGROUND OF THE INVENTION

This invention is directed to building products, particularly novel window, door frames, and the like, and to such products being made by extruding certain thermoplastic resins. The structure may be a co-extruded profile of at least two thermoplastic resins such as a vinyl aromatic polymer composition and an ultra violet light (UV) and weather resistance coating thereover. It may also be a single extruded polymer profile.

There is prior art with respect to a window assembly of a rigid plastic material employing polyvinyl chloride. U.S. Pat. No. 4,831,781 is directed to such a material for window jamb and head members which may be hollow. U.S. Pat. No. 4,516,356 is directed to an insulated plastic frame for doors, windows and the like wherein the window and door frames are made of extruded plastic. The extruded plastic structure employs polyvinyl chloride and the hollow sections of the plastic structure are filled with an insulating material such as a foamed material. U.S. Pat. No. 4,130,976 is directed to frames for doors, windows and the like consisting of a hollow metal profile within a foamed synthetic resin profile. The outer portion of the synthetic resin profile is a densified resin outer skin. U.S. Pat. No. 3,964,231 is directed to a plastic-encased metallic hollow profile member. The profile consists of a metallic hollow profile member having a plastic sheath extruded thereover. None of these references, however, disclose or suggest the unique structure of the present invention or the advantages achieved thereby, as well as the particular thermoplastics employed herein.

In today's market, thermoplastic polymers, particularly polyvinyl-chloride (vinyl), have found extensive use in door and window frame construction and in siding. However, vinyls have a problem in that they are not very resistant to the extreme heats of the southerly and westerly sections of the United States of America, or the hot climates in other parts of the world. White pigmented vinyls are particularly used in such warm climates, but even they will fail in that they can crack or deform due to heat build-up. Dark pigmented vinyls are even worse with respect to heat resistance or heat build-up. In addition, to obtain rigidity (stiffness), thicker walled sections have been made. However, even heavier walled vinyls still suffer from heat build-up and can crack or deform, although to a lesser degree because of the heavier walled sections. Hollow metal profile with vinyl coverings are used as shown in the above art.

The heat build-up that occurs in the hot weather is in the infrared spectrum. The heat build-up causes shrinkage of the vinyl parts, thereby resulting in breakage, softening and/or deformation where the vinyl parts are in a restrained mode, such as a window or door frame. What probably occurs is that as the heat builds up, temperatures of the vinyl can exceed its glass transition temperature (Tg). When the temperature of the vinyl goes above its Tg, the stresses developed in the vinyl during extrusion are relieved, thereby causing it to shrink. When the vinyl shrinks, it may crack or warp, if the vinyl profile or frame is restrained.

SUMMARY OF THE INVENTION

The present invention is directed to a unique profile structure for products for the building industry and particular thermoplastic resins for such products. The plastic system and profile structure have good heat and weather resistance, and as such, are suitable for any climate around the world. Therefore, they do not face geographic limitations. Also, the unique structure and plastic system are able to use less material than corresponding traditional designs, while still maintaining structural rigidity. In addition, the plastic system utilized in this invention not only reduces material and material cost, but also allows higher output because of faster cooling. Thus, this invention results in a high energy efficient system, a high temperature resistant structure, and an environmentally beneficial system since less thermoplastic resin is employed compared to traditional thermoplastic systems. The unique structure of this invention is referred to as a high definition profile structure.

Therefore, it is an object of this invention to provide a rigid thermoplastic high definition profile structure.

Another object of this invention is to provide a thermoplastic composite of one or more thermoplastic polymers.

Still another object of this invention is to provide a rigid thermoplastic frames for openings in buildings.

DETAILED DESCRIPTION OF THE INVENTION

This invention is directed to an extruded high definition profile structure as defined in the drawings and text of this invention. Specifically, the unique high definition profile structure of this invention comprises a central hollow cross section member having at least two longitudinal flange members with at least one of each such flange member extending longitudinally from the opposite sides of the cross sectional hollow member. Each flange may also be a hollow flange member or a solid flange member. The central cross sectional hollow member may have more than one longitudinal flange member extending longitudinally and perpendicularly to the central hollow cross sectional member. It is to be understood, however, that there is at least one longitudinal flange member extending longitudinally and perpendicularly from each side of the hollow cross sectional member. Preferably, there are three flange members extending perpendicularly and longitudinally in essentially parallel relationship from one side of the hollow cross sectional member and one flange member extending longitudinally and perpendicularly from the opposite side thereof. The longitudinal flange members may be hollow or solid. If they are hollow, they may have one or more rib members extending longitudinally through the length of the flange member and perpendicular to the side walls of the flange. The central hollow cross sectional member may have one or more rib members extending longitudinally through the length of the central hollow section in a vertical orientation position. On the other hand, in a preferred embodiment, the central hollow section may have a corrugation of rib members extending longitudinally therethrough. The corrugation can be of various designs, as shown in the drawings of the high definition profile structure of this invention and are referred to in this invention as torsional stabilizers. In the preferred embodiment, the side having three flange members extending from the central cross sectional member form channel-like or U-shaped recesses that can receive and hold a vertical moveable panel, as for example, a window pane and frame. The preferred structure of this invention could also form the door frame for a horizontal sliding door or a skylight frame. In fact, the preferred structure of this invention can be employed as framing for any type of opening in a building. Also in the preferred structure of this invention, the single flange extending from the opposite side of the three flange members is sometimes called the attachment or nailing flange. It is this flange that is attached to the building to secure the window or door frame or the like to the building. In a window frame, the sides are generally referred to as "jambs", the top generally as a "header" and the bottom generally as a "sill".

The central hollow cross sectional member, as stated previously, may be completely hollow or have one or more ribs extending longitudinally therethrough in a vertical orientation position or have a rib corrugation configuration extending longitudinally therethrough. If the cross sectional member is to be completely hollow, it may be filled with insulation, wood, metal or any other suitable material used in the building trade.

The thermoplastic materials that can be employed in the high definition profile structure of this invention can generally be any thermoplastic material depending on the geographical region in which the profile, when converted into a building product, would be used or depending upon the building code for the region. Preferably, the thermoplastic materials are high temperature thermoplastics such as acrylonitrile-butadiene-styrene (ABS), polycarbonate, polycarbonate/ABS blend, a co-polycarbonate-polyester, acrylic-styrene-acrylonitrile (ASA), acrylonitrile-(ethylene-propylene diamine modified)-styrene (AES), polyalkylene terephthalate such as polybutylene terephthalate (PBT) or polyethylene terephthalate (PET) or blends thereof, blends of polyphenylene ether/polyamide (NORYL GTX® from General Electric Company), blends of polycarbonate/polybutylene terephthalate and impact modifier (XENOY® resin from General Electric Company), blends of polycarbonate/PBT/PET, etc., or blends thereof with other additives such as fillers, impact modifiers, pigments, stabilizer, reinforcing agents, etc. The high definition profile can be a laminate or composite which may be prepared by co-extrusion or other lamination methods. For example, the base or substrate could be a polyalkylene terephthalate, such as PBT, with an outer layer of ASA or polyvinyl chloride (PVC) or a blend thereof. Another laminate could be a substrate of a polycarbonate and an outer layer of ASA or PVC or a blend thereof. In fact, the high definition profile could comprise a three layer laminate. However, it is preferable that in a laminate that the outer laminate be a weather and ultra-violet light (UV) resistant thermoplastic. Obviously, if the thermoplastic polymer being employed is inherently weather and UV resistant, an outer laminate would not be necessary. The preferred system is a laminated high definition profile comprising a base or substrate 26 of ABS and a thin outer layer 28 of ASA or a blend of ASA and PVC. The outer layer is a thin layer of about 0.001" to about 0.100" thick, and preferably about 0.005" to about 0.050" thick, and more preferably 0.010" to about 0.020" thick. In fact, the outer layer of a laminate can be a vinyl film (PVC), a flourocarbon film (PTFE) or highly plasticized vinyl film having a thickness of 1 to 50 mils.

While PVC can be used solely in the unique high definition profile of this invention, building products such as window, door frames or other frames made therefrom should be limited to cool geographical regions where the heat build-up (infrared) does not exceed about 160° F., which is about the Tg of PVC. Otherwise, as stated previously herein, when employed in a restrained structure, the vinyl (PVC) will shrink, and thus crack, craze and/or deform.

As also stated previously, the unique profile of this invention has many advantages. When using the preferred thermoplastics of this invention, the profile has a much faster cooling rate during extrusion, since the composition has a lower specific gravity (1.05) as compared to PVC (1.4). Thus, PVC cannot cool as fast as the preferred composition of this invention and may have a tendency to warp, form sink marks or deform during extrusion. The preferred thermoplastic of this invention also leads to a faster rate of extrusion. In addition, because of the rigidity of the profile or structure of this invention compared to conventional thermoplastic structures for windows and doors, less thermoplastic material can be used for comparable rigidity. In some instances, as much as 50 percent less material has been achieved due to thinner wall sections while maintaining comparable rigidity to vinyls, i.e. resistance to twisting or buckling.

DETAILED DESCRIPTION OF THE DRAWINGS

Figure 1:
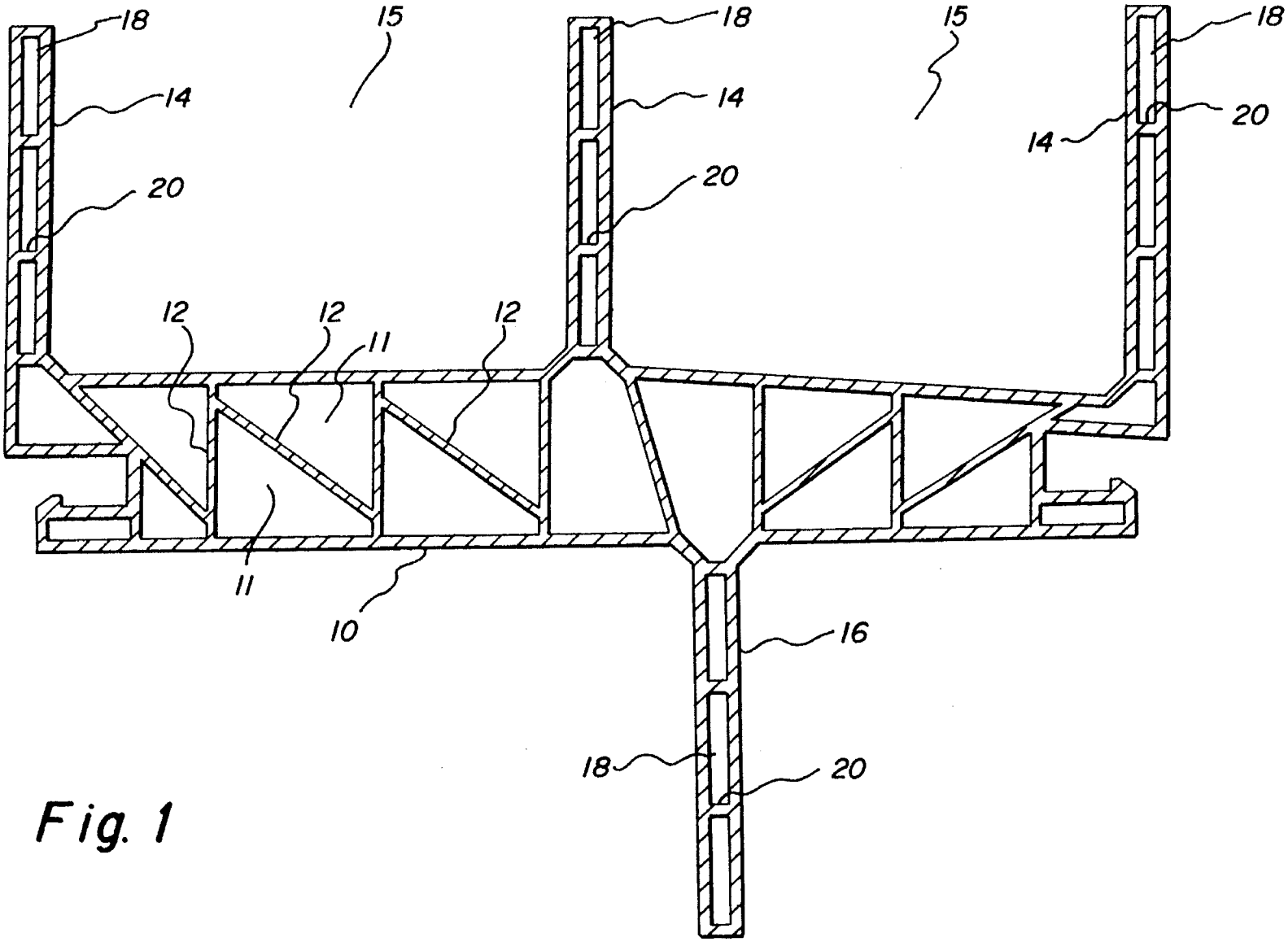
FIG. 1 shows a cross section of one embodiment of the profile of this invention.

FIG. 1 is a cross section of one embodiment of the high definition profile of this invention showing central hollow cross sectional member 10, with hollow sections 11, torzional stabilizer ribs 12, flanges 14, which form channel-like recesses 15, and attachment or nailing flange 16. In the FIG. 1, flanges 14 and 16 have hollow sections 18 and ribs 20.

Figure 2:
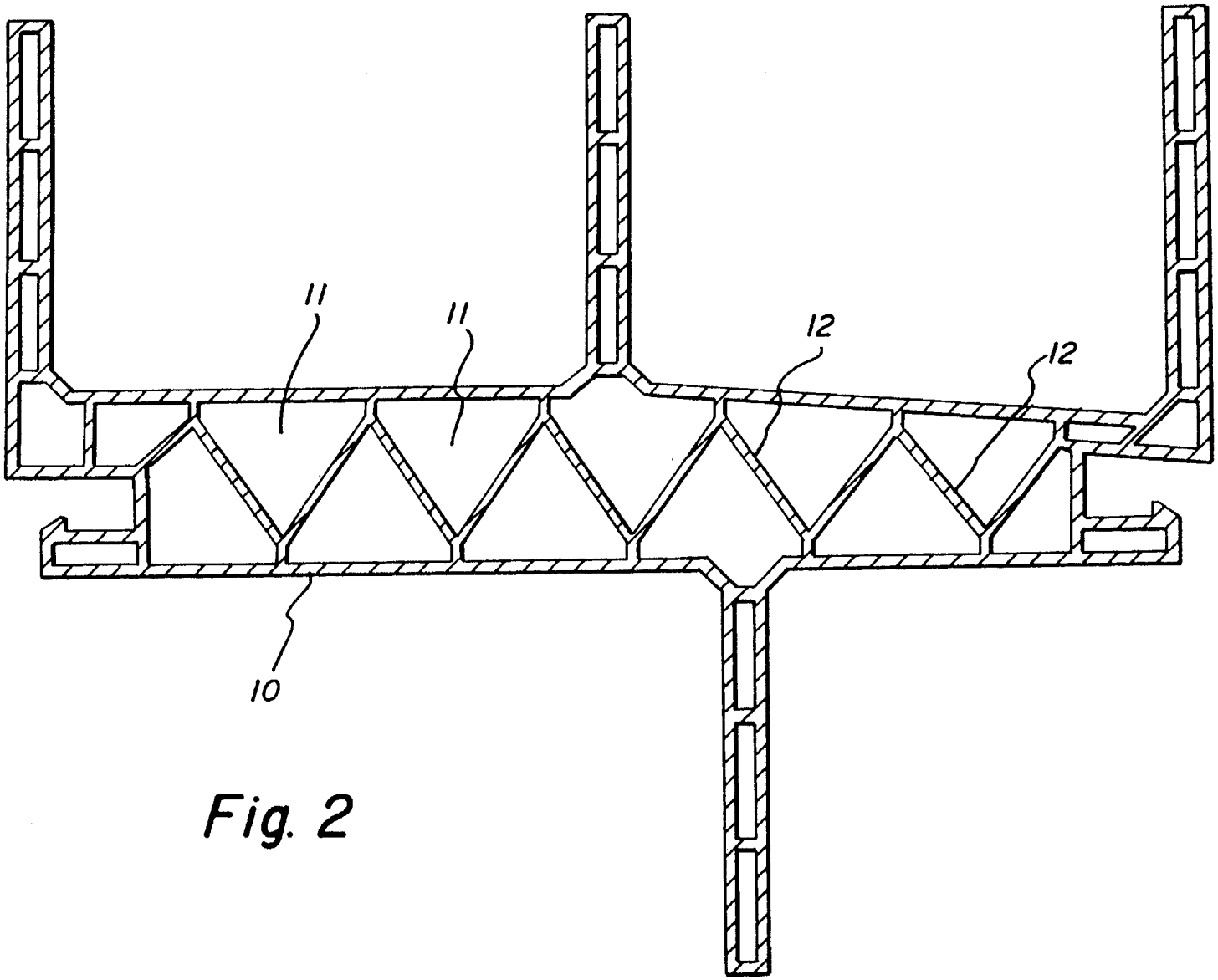
FIG. 2 shows a cross section of another embodiment of the profile of this invention.

FIG. 2 is another embodiment of the high definition profile of this invention showing central hollow cross section member 10 with hollow sections 11 and torzional stabilizer ribs 12. The identification of the remaining parts are the same as in FIG. 1.

Figure 3:
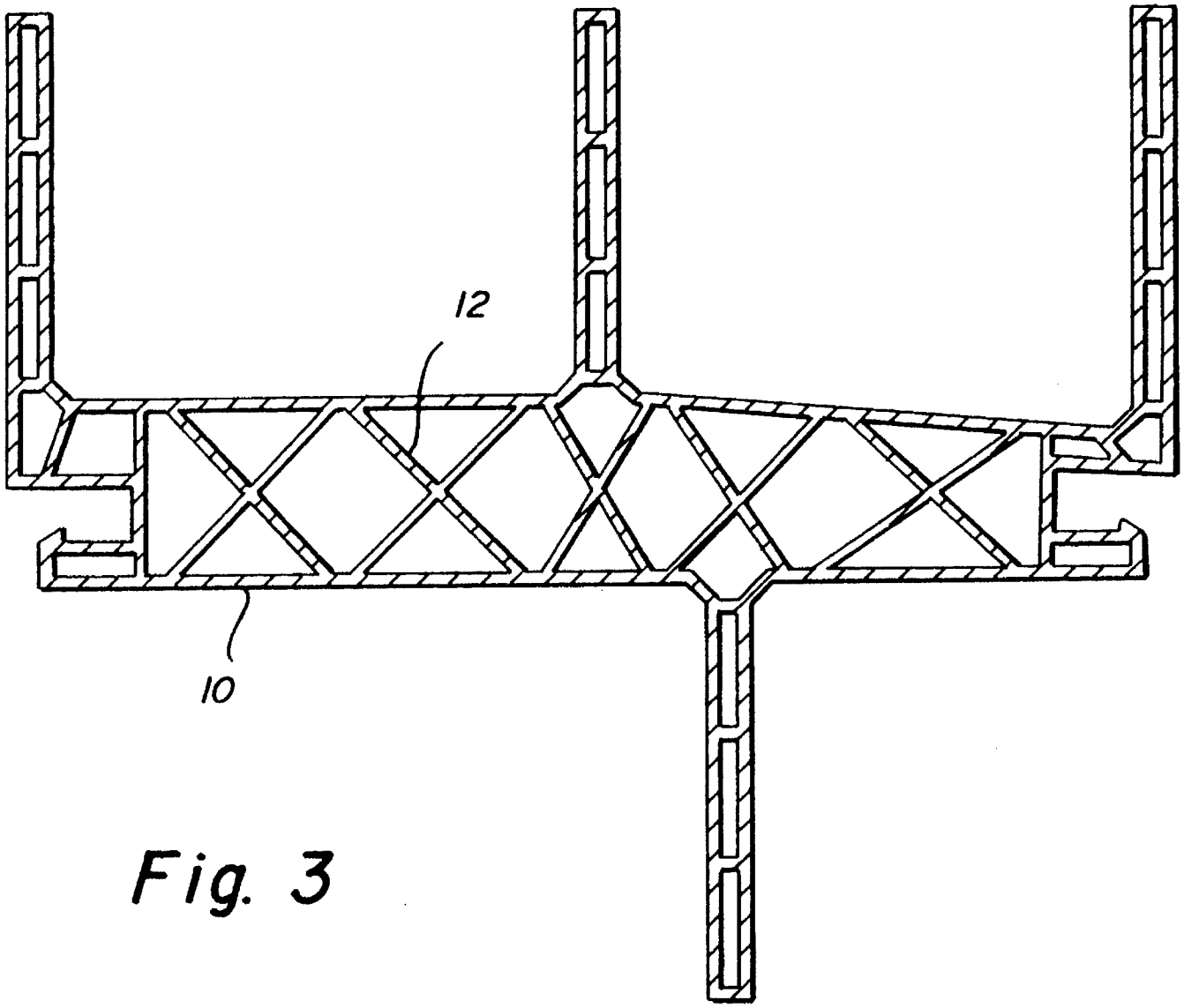
FIG. 3 shows a cross section of yet another embodiment of the profile of this invention.

FIG. 3 is yet another embodiment of the high definition profile of this invention showing the corrugation rib configuration in the central hollow sectional member 10. Again, the identification of the other parts is the same as in FIG. 1 and FIG. 2. The torzional stabilizer ribs 12 are in a corrugation network.

Figure 4:
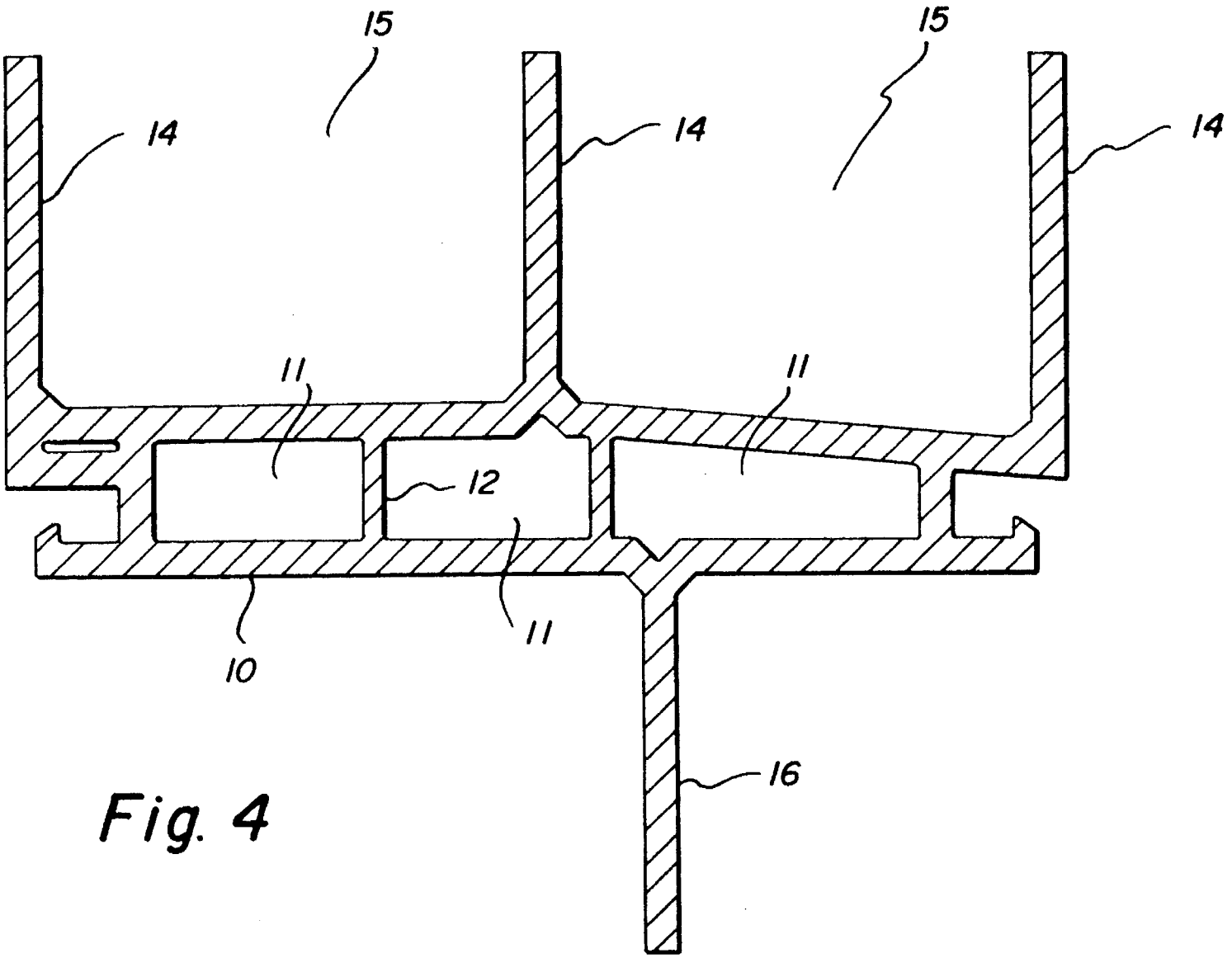
FIG. 4 shows a cross section of still another embodiment of the profile of this invention.

FIG. 4 is still another embodiment of the high definition profile of this invention showing central hollow cross sectional member 10 with hollow sections 11 and with vertical torzional stabilizer ribs 12. Flanges 14 form channel-like recesses 15. Attachment or nailing flange 16 and flanges 14 are solid in this embodiment.

FIG. 5 shows a detailed partial cross-section of a cross sectional member 10.

While the form of the high definition profile and thermoplastic materials employed therewith as described in the present invention constitutes preferred embodiments, it is to be understood that the invention is not limited to this precise form and that changes and modifications may be made thereon without departing from the scope and spirit of the invention as defined in the appended claims.

What is claimed is:

1. A thin walled, thermoplastic high definition profile structure suitable for building products comprising an essentially central hollow cross sectional member having at least two longitudinal flange members extending in a perpendicular orientation position to the central hollow cross sectional member, wherein at least one flange member extends perpendicularly from one side of the central hollow cross sectional member and at least additional flange member extends perpendicularly from the other side of the central hollow cross section member, said cross sectional member, said one flange member, and said additional flange member comprise a thermoplastic polymer material comprising a substrate and an outer weather and ultra violet light resistant layer, said thermoplastic polymer material having a glass transition temperature of greater than about 160° F., said substrate is a rigid acrylonitrile-butadiene-styrene polymer and said outer layer is a polymer selected from the group consisting of (a) an acrylic-styrene-acrylonitrile polymer, (b) a blend of an acrylic-styrene-acrylonitrile polymer with polyvinyl chloride, and (c) a blend comprising at least 50 percent by weight of an acrylonitrile-styrene acrylate polymer.

2. The high definition profile structure of claim 1 wherein said one flange member and said additional flange member are hollow.

3. The high definition profile structure of claim 1 wherein the central hollow cross sectional member has torsional stabilizer ribs in a corrugation configuration extending longitudinally through the hollow section of the cross sectional member.

4. The high definition profile structure of claim 1 wherein the hollow cross sectional member has at least one longitudinal rib extending vertically between opposite sides of the hollow cross sectional member.

5. The high definition profile structure of claim 1 wherein the outer weather and ultra violet light resistant layer has a thickness of about 0.001" to about 0.100".

* * * * *